US007338268B2

(12) United States Patent
Lee

(10) Patent No.: US 7,338,268 B2
(45) Date of Patent: Mar. 4, 2008

(54) DISCHARGE VALVE DEVICE OF A COMPRESSOR

(75) Inventor: Jea-won Lee, Hwasung-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 296 days.

(21) Appl. No.: 10/976,901

(22) Filed: Nov. 1, 2004

(65) Prior Publication Data

US 2005/0142019 A1 Jun. 30, 2005

(30) Foreign Application Priority Data

Dec. 26, 2003 (KR) ..... 10-2003-0097592

(51) Int. Cl.
*F01C 21/00* (2006.01)
*F03C 2/00* (2006.01)
*F04C 15/00* (2006.01)
*F04C 29/00* (2006.01)

(52) U.S. Cl. ..... 418/270; 418/63; 418/156; 418/DIG. 1; 137/852; 137/855

(58) Field of Classification Search ..... 418/63, 418/156, 270, DIG. 1; 137/852, 853, 855, 137/856

See application file for complete search history.

(56) References Cited

U.S. PATENT DOCUMENTS

| | | | | |
|---|---|---|---|---|
| 4,199,309 | A * | 4/1980 | Connor | 418/270 |
| 4,537,567 | A * | 8/1985 | Kawaguchi et al. | 418/63 |
| 4,764,099 | A * | 8/1988 | Nakajima et al. | 418/270 |
| 5,372,483 | A | 12/1994 | Kimura et al. | |
| 5,709,535 | A | 1/1998 | Enomoto et al. | |
| 5,871,337 | A | 2/1999 | Fukanuma et al. | |
| 5,879,145 | A | 3/1999 | Baumgartner | |
| 6,318,972 | B1 | 11/2001 | Huang et al. | |

FOREIGN PATENT DOCUMENTS

| | | | | |
|---|---|---|---|---|
| JP | 20-1979-0177608 | U | 6/1978 | |
| JP | 20-1980-0180987 | U | 12/1980 | |
| JP | 57041493 | A * | 3/1982 | 418/63 |
| JP | 20-1982-0139685 | U | 9/1982 | |
| JP | 61-192884 | A | 8/1986 | |
| JP | 20-1990-0115983 | U | 9/1990 | |
| JP | 6-147125 | A | 5/1994 | |
| JP | 9-119387 | A | 5/1997 | |
| JP | 11-280685 | A | 10/1999 | |
| JP | 2003-286953 | A | 10/2003 | |
| KR | 1993-006325 | Y1 | 4/1993 | |
| KR | 10-0253237 | B1 | 1/2000 | |
| KR | 10-0305862 | B1 | 8/2001 | |

* cited by examiner

*Primary Examiner*—Theresa Trieu
(74) *Attorney, Agent, or Firm*—Sughrue Mion, PLLC

(57) ABSTRACT

A compressor includes a casing, a driving part adapted to be accommodated in the casing for generating a driving force, a compression part for compressing gas with the driving force from the driving part and provided with an inlet for inhaling the gas and an outlet for discharging the compressed gas, and a valve apparatus for opening and closing the outlet. The valve apparatus has a valve body accommodation part including an inner surface of a cylindrical shape for communicating with the outlet, and connected to a gas discharging path for discharging the compressed gas discharged through the outlet; and a valve body accommodated in the valve body accommodation part and curved to close the outlet elastically and to open the outlet with the compressed gas of the compression part.

8 Claims, 10 Drawing Sheets

DISCHARGE VALVE DEVICE OF A COMPRESSOR

CROSS-REFERENCE TO RELATED APPLICATIONS

This application claims the benefit of Korean Patent Application No. 2003-0097592, filed Dec. 26, 2003, in the Korean Intellectual Property Office, the disclosure of which is incorporated herein by reference.

BACKGROUND OF THE INVENTION

1. Field of the Invention

An apparatus consistent with the present invention relates to a compressor, and more particularly, to a compressor having an improved structure of a valve apparatus opening/closing an outlet through which gas compressed in a compression chamber is discharged.

2. Description of the Related Art

Generally, a compressor includes a casing, a driving part accommodated in a casing for generating a driving force, a compression part provided with an inlet inhaling and compressing gas by the driving part and an outlet discharging the compressed gas, and a valve apparatus that opens and closes the inlet and the outlet of the compression part. Also, the compressor is commonly installed in an air conditioner or refrigerator and functions to compress coolant.

The compressor is either a rotary compressor, a linear compressor, a reciprocating compressor, or a wobble plate compressor according to a driving method or a shape of the compression part.

The valve apparatus is provided in the inlets and outlets to release or block the gas entering and exiting the compression chamber.

Hereinbelow, a rotary type compressor will be described.

FIGS. 1, and 2 are cross-sectional and longitudinal section views of a conventional rotary compressor, respectively. As shown therein, a conventional compressor 101 comprises a casing 103 forming a closed space, a compression part 120 accommodated in the casing 103 for compressing coolant, and a driving motor 110 supplying a driving force to the compression part 120.

A coolant supplying tube 107 supplying the coolant to the compression part 120 is installed on an outside of the casing 103. Also, a coolant discharging tube 108 discharging the coolant compressed in the compression part 120 to outside of the casing 103 is installed on a top area of the casing 103, and an oil accommodating part 109 accommodating oil supplied for lubricating and cooling of driving components is formed on a bottom area of the casing 103.

The compression part 120 comprises a cylinder 121 of a cylindrical shape forming a compression space, a roller 127 contacting rollably an inner surface of the cylinder 121, and a vane 129 protruding from the inner surface of the cylinder 121 retractably and comprising a protruding end contacting an outer surface of the roller 127 to partition an inner space of a compression chamber 123 into a compressing space and an inhaling space.

A top flange 131 and a bottom flange 133 blocking opened areas to form the compression chamber 123 compressing the coolant are installed on opened top and bottom ends, respectively. An inlet 137 inhaling the coolant and the outlet 139 are formed on the inner surface of the cylinder 121. A valve apparatus 140 is provided on a top side of the top flange 131 to open/close the outlet 139.

The driving motor 110 comprises a stator 111 installed on the inner wall of the casing 103, and a rotator 113 of a cylindrical shape inserted into the stator 111 rotatably. A central area of the rotator 113 is inserted with a rotation shaft 115 capable of rotating with the rotator 113 as one body.

The rotation shaft 115 passes the compression part 120, and extends down to the oil accommodating part 109. A bottom area of the rotation shaft 115 is coupled with the roller 127 eccentrically so that the roller 127 can be rotating whiling contacting the inner surface of the cylinder 121 rollably.

The valve apparatus 140 comprises a reed valve 141 opening/closing the outlet 139, and a stopper 145 limiting elastic deformation of the reed valve 141.

The reed valve 141 comprises a valve body 142 provided in a plate shape, and a screw 143 coupling the valve body 142 to the top flange 131. The valve body 142 is provided with an elastic metal material in a plate shape. A first part of the valve body 142 closes the outlet 139, while a second part thereof is coupled to the top flange 131 with the screw 143. In other words, the valve body 142 is centered in place at the screw 143, while the first part of the valve body 142 is deformed by the compressed coolant discharged toward the outlet 139 so that the outlet 139 can be opened.

The stopper 145 is coupled by the second part of the valve body 142 and the screw 143 in a bent form to prevent excessive deformity of the valve body 142.

Accordingly, the conventional compressor 101 can compress the coolant as the roller 127 rotates in the cylinder 121 by the driving motor 10. The coolant compressed in this way can be discharged to the coolant discharging tube 108 through the outlet 139 as it deforms the valve body 142.

However, one of the disadvantages in the conventional compressor is that stress is excessively focused on the second part of the valve body as the valve body repeatedly deforms while being centered at the screw, which shortens a life cycle of the compressor.

Also, it is disadvantageous that there exists an uncompressible area, such as the outlet in the conventional compressor, which lowers compression efficiency.

Accordingly, an additional member, such as the stopper, is required to limit excessive deformity of the valve body by the compressed coolant in the conventional compressor valve.

SUMMARY OF THE INVENTION

Illustrative, non-limiting embodiments of the present invention overcome the above disadvantages and other disadvantages not described above. However, the present invention is not required to overcome the disadvantages described above, and, thus, an illustrative, non-limiting embodiment of the present invention may not overcome any of the problems described above.

Accordingly, it is an aspect of the present invention to provide a compressor that extends a life cycle of a valve body and improves compression efficiency.

Also, it is another aspect of the present invention to provide a compressor comprising a valve apparatus of a simple structure which does not require an additional member for limiting deformity of a valve body.

Additional aspects and advantages of the invention will be set forth in part in the description which follows and, in part, will be understood from the description, or may be learned by practice of the invention.

The foregoing and other aspects of the present invention are achieved by providing a compressor comprising a casing, a driving part to be accommodated in the casing for generating a driving force, a compression part for compressing gas with the driving force from the driving part and provided with an inlet for inhaling the gas and an outlet for discharging the compressed gas, and a valve apparatus for opening/closing the outlet. The valve apparatus comprises a valve body accommodation part comprising an inner surface of a cylindrical shape for communicating with the outlet, and adapted to be connected to a gas discharging path provided to discharge the compressed gas discharged through the outlet. The valve body is adapted to be accommodated in the valve body accommodation part and curved to close the outlet elastically and to open the outlet with the compressed gas of the compression part.

According to an aspect of the invention, the valve body comprises: a first end for closing/opening the outlet; a second end adapted to be coupled with the valve body accommodation part for preventing the valve body from rotating relative to the valve body accommodation part; and a main body provided between the first end and the second end, and curved to be adjacent to the inner surface of the valve body accommodation part.

According to another aspect of the invention, the second end extends from the main body toward an outside, and the inner surface of the valve body accommodation part is provided with a coupler to accommodate and couple with the second end.

According to another aspect of the invention, the inner surface of the valve body accommodation part is provided with a protrusion for protruding toward the valve body, and the second end is provided with a protrusion accommodation part adapted to accommodate and couple with the protrusion.

According to another aspect of the invention, the inner surface of the valve accommodation part has a cylindrical shape.

According to another aspect of the invention, the compression part comprises: a moving part adapted to be operated by the driving part; and a cylinder provided with the inlet and the outlet, and coupled with the moving part to form a compression chamber for compressing the inhaled gas.

According to another aspect of the invention, the moving part comprises: a roller adapted to be coupled eccentrically relative to the driving part, for contacting an inner surface of the cylinder rollably, and a vane adapted to be coupled with the inner surface of the cylinder retractably, for contacting the roller.

According to yet another aspect of the invention, the moving part comprises a piston coupled relative to the driving part, for reciprocating in the cylinder.

BRIEF DESCRIPTION OF THE DRAWINGS

These and/or other aspects and advantages of the present invention will become apparent and more readily appreciated from the following description of the illustrative, non-limiting embodiments, taken in conjunction with the accompanying drawings, in which.

DETAILED DESCRIPTION OF EXEMPLARY EMBODIMENTS OF THE INVENTION

Figure 1:
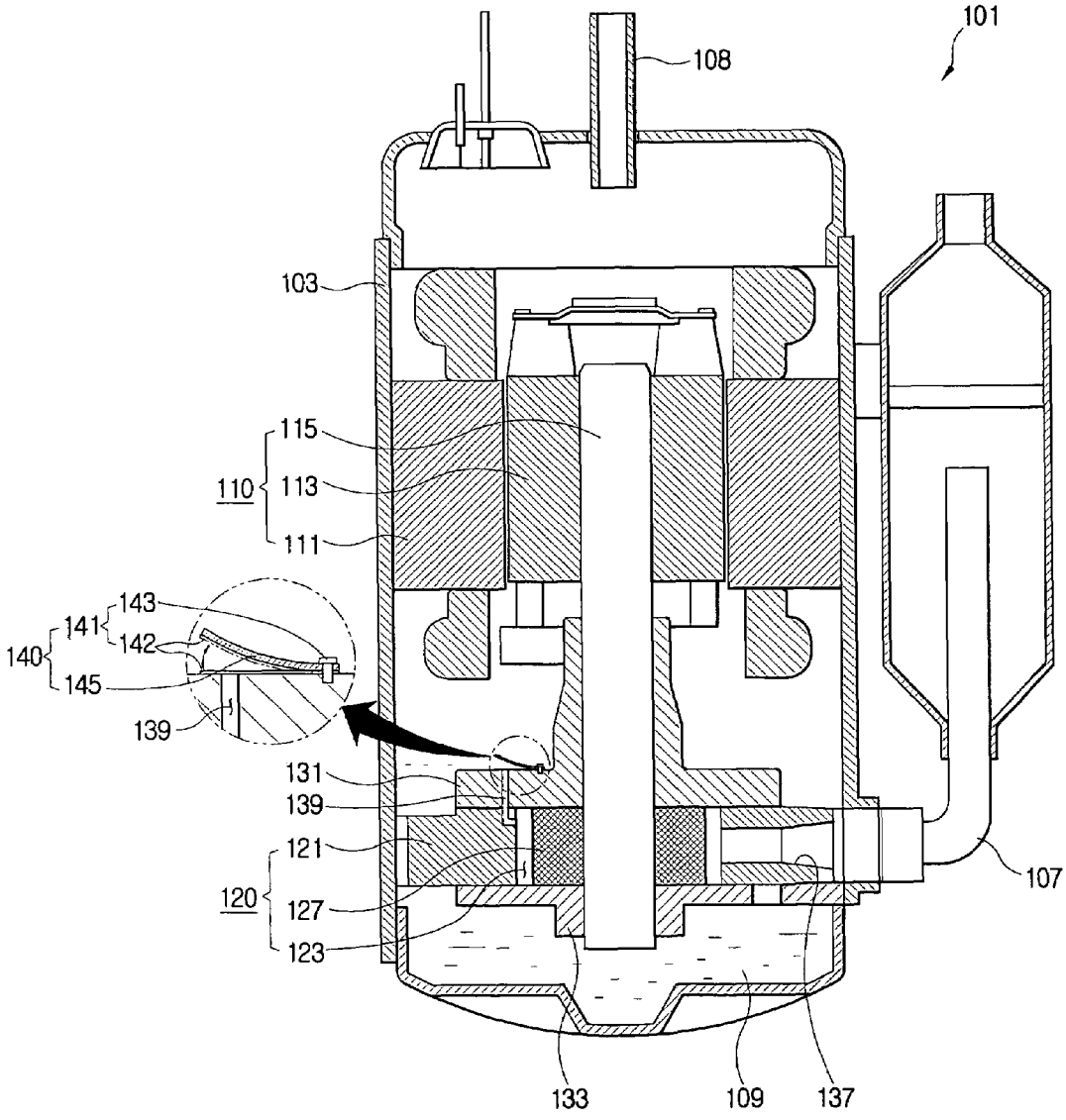
FIG. 1 (PRIOR ART)
FIG. 1 is a longitudinal sectional view of a conventional compressor.
Figure 2:
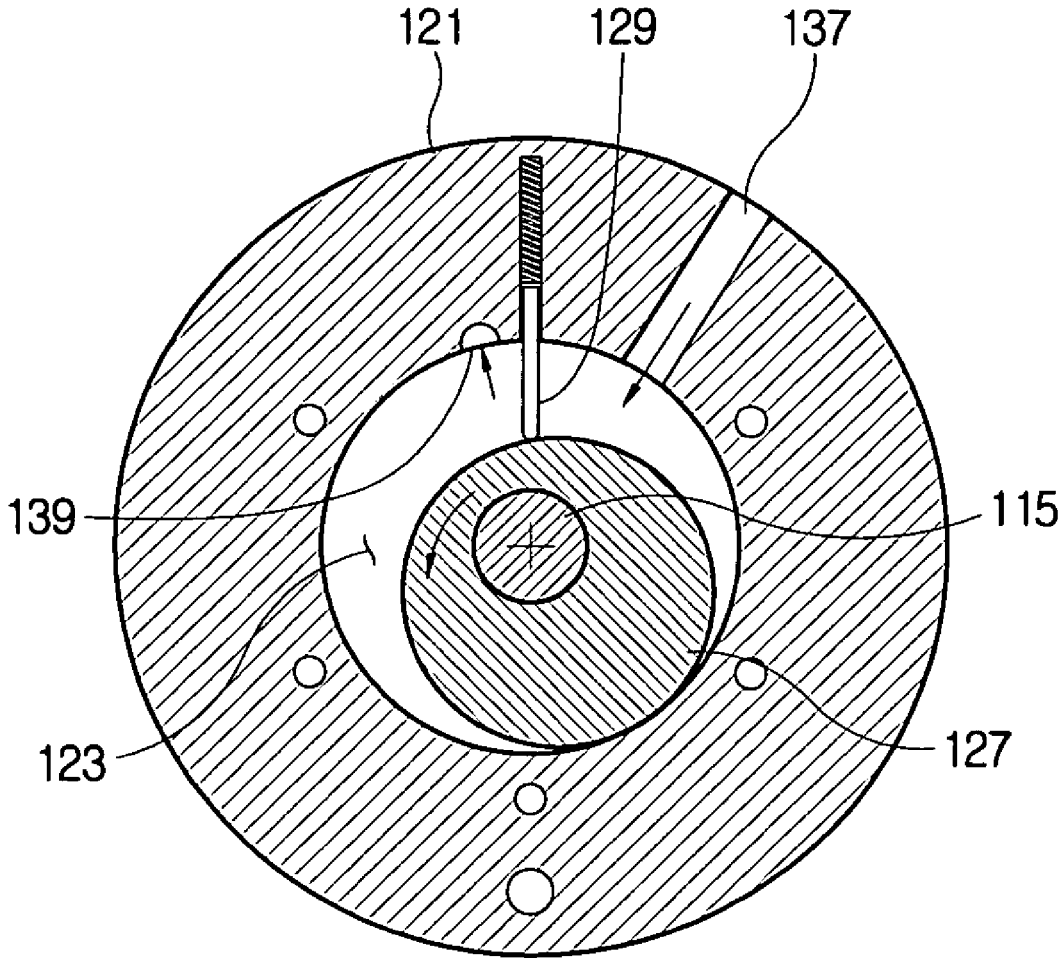
FIG. 2 (PRIOR ART)
FIG. 2 is a cross sectional view of the compressor in FIG. 1.

Reference will now be made in detail to illustrative, non-limiting embodiments of the present invention, examples of which are illustrated in the accompanying drawings, wherein like reference numerals refer to like elements throughout. The exemplary embodiments are described below in order to explain the present invention by referring to the figures.

Figure 3:
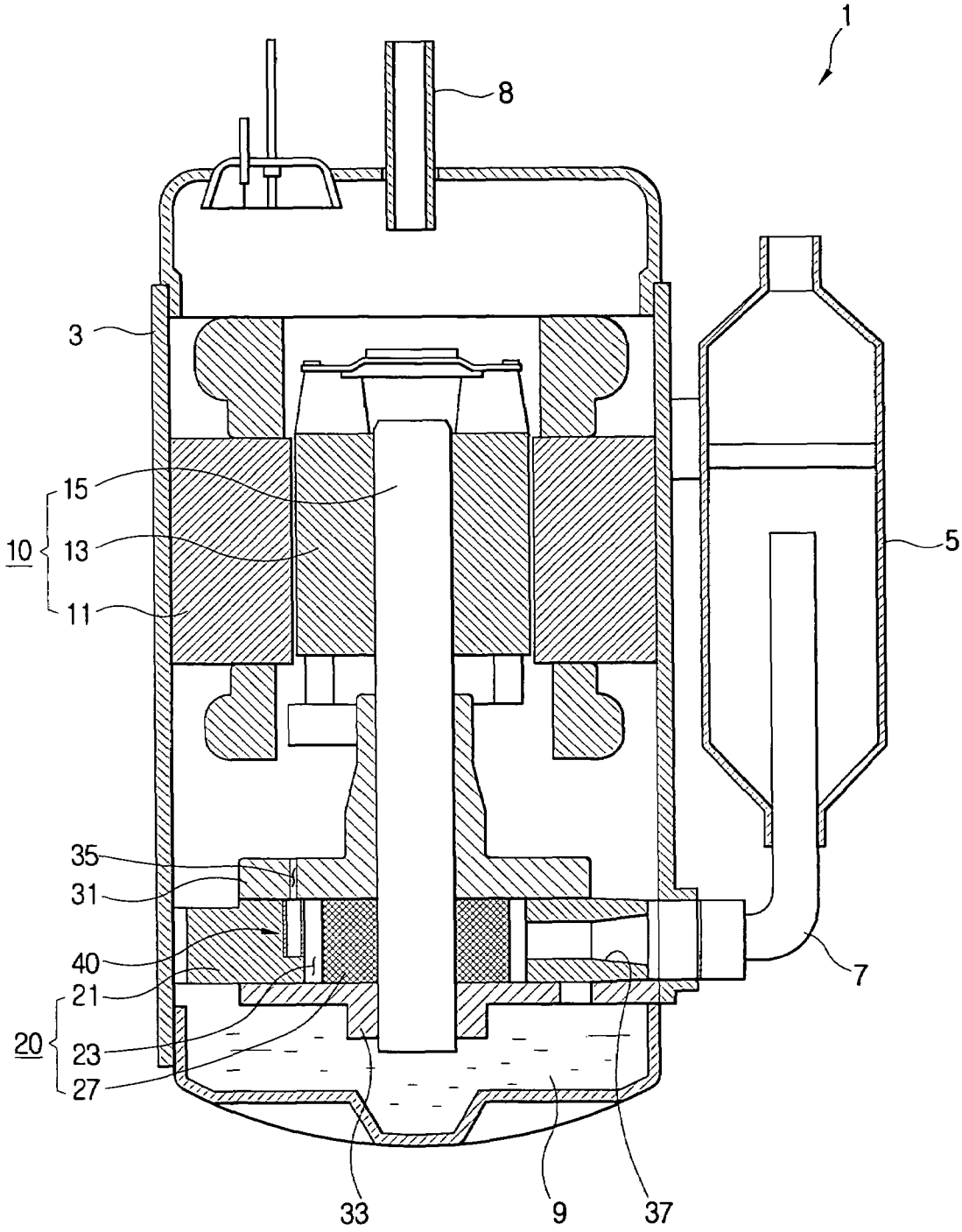
FIG. 3 is a cross sectional view of a compressor according to a first embodiment of the present invention.
Figure 4:
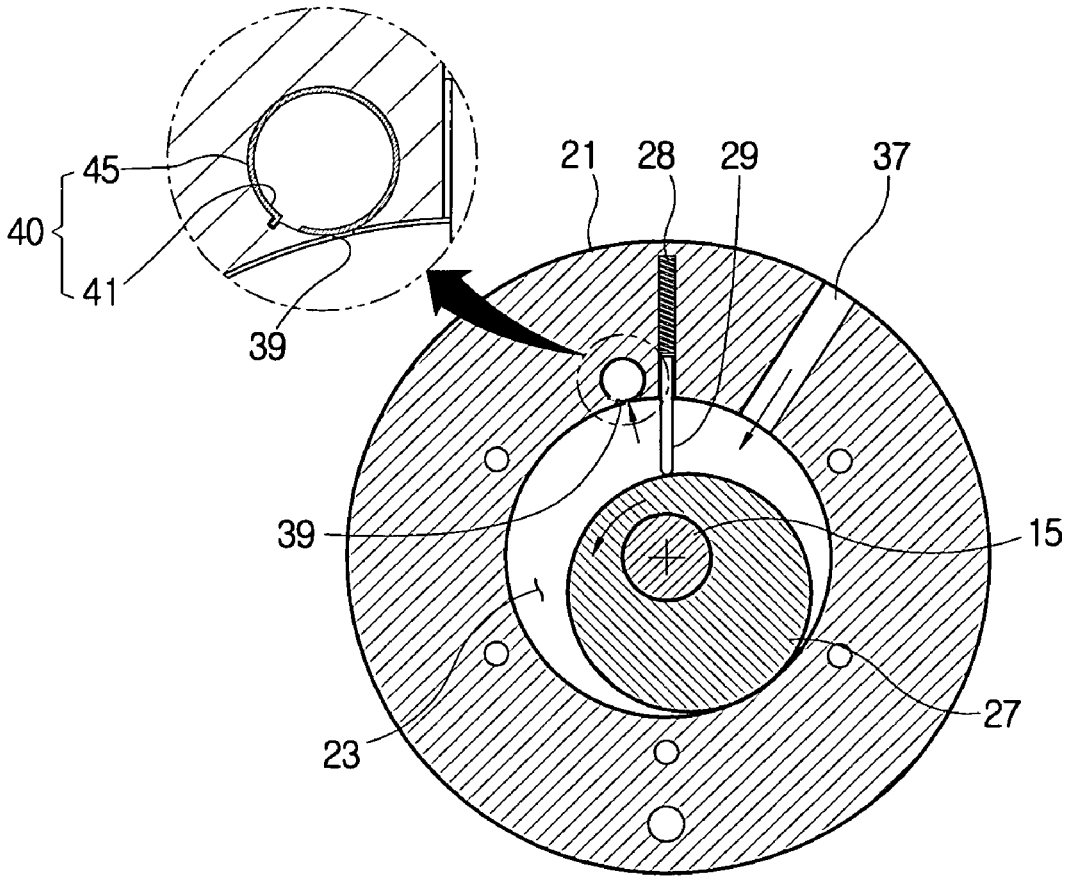
FIG. 4 is a cross sectional view of the compressor in FIG. 3.
Figure 5:
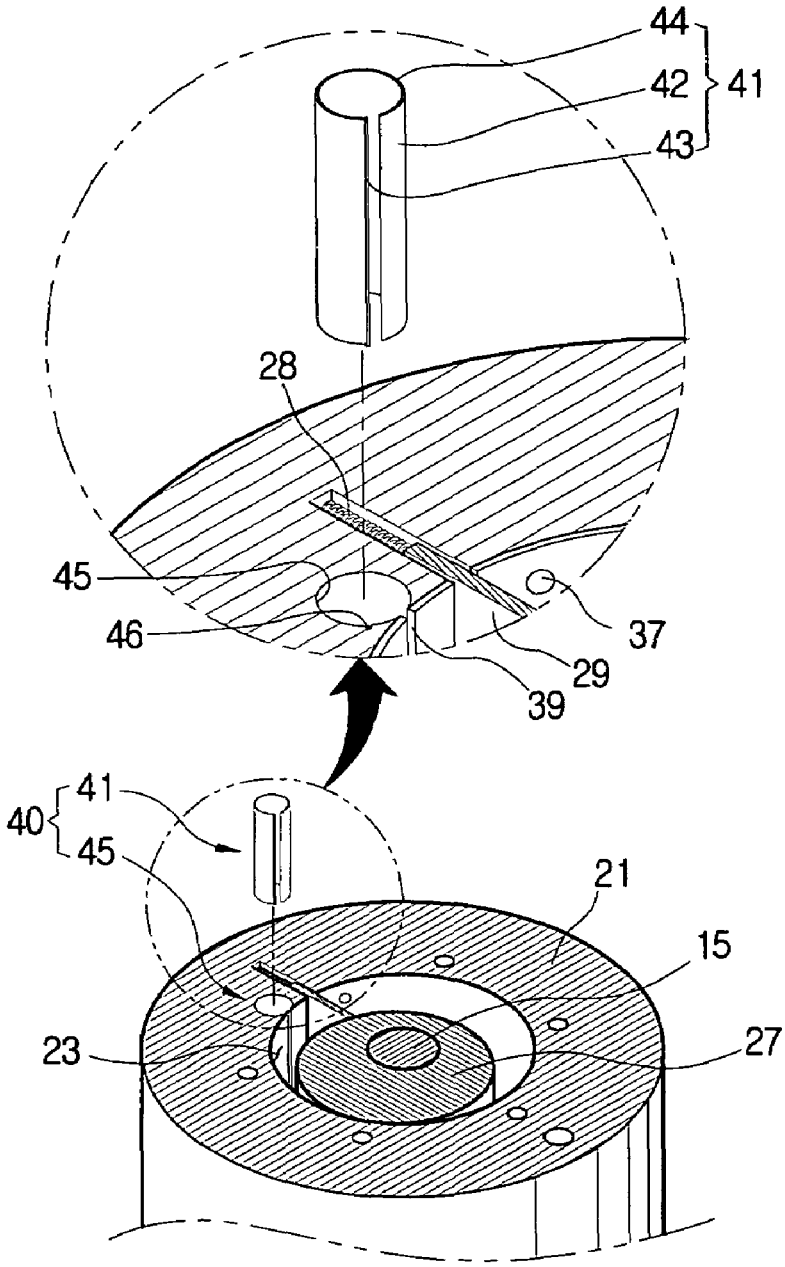
FIG. 5 is an exploded perspective view of a valve apparatus of the compressor in FIG. 4.

As shown in FIGS. 3 through 5, a compressor according to a first embodiment of the present invention is described as an example of a rotary compressor. Thus, a compressor 1 according to the first embodiment of the present invention comprises a casing 3 forming a closed space, a compression part 20 accommodated in the casing 3 and compressing gas such as coolant, and a driving motor 10 supplying driving force to the compression part 20.

An accumulator 5 for supplying the gas in a vapor state to the compression part 20 is installed on an outside of the casing 3, and a gas supply tube 7 is installed between the compression part 20 and the accumulator 5. Also, a gas discharging tube 8 for discharging the gas compressed in the compression part 20 to the outside of the casing 3 is installed on a top area of the casing 3, while an oil accommodation part 9 for accommodating oil supplied for lubricating and cooling of driving components in the casing 3 is formed on a bottom area.

The compression part 20 includes a moving part for compressing the gas. In this exemplary embodiment the compression part 20 comprises a cylinder 21 of a cylindrical shape forming a compression chamber 23, a roller 27 contacting rollably an inner surface of the cylinder 21, and a vane 29 protruding retractably from the inner surface of the cylinder 21 by an elastic member 28 and partitioning the compression chamber 23 of the cylinder 21 into a compressing space and an inhaling space as a protruding end contacts an outer surface of the roller 27.

A top flange 31 and a bottom flange 33 closing opened areas are installed on opened upper and lower ends of the cylinder 21, respectively, to form the compression chamber 23 compressing the gas. On the inner surface of the cylinder 21, an inlet 37 inhaling the gas and an outlet 39 are formed. A valve apparatus 40 is provided in the cylinder 21 to open/close the outlet 39.

The driving motor 10 comprises a stator 11 installed in the casing 3, and a rotator 13 of a cylindrical shape inserted rotatably into the stator 11. A rotation shaft 15 is inserted in a central area of the rotator 13 so that it can rotate with the rotator 13 as one body.

The rotation shaft 15 passes the compression part 20, extending downward to the oil accommodation part 9, and a bottom end area thereof is coupled with the roller 27 eccentrically to enable the roller 27 to contact the inner surface of the cylinder 21 rollably.

The valve apparatus 40 comprises a valve body accommodation part 45 for communicating with the outlet 39, and a valve body 41 accommodated in the valve body accommodation part 45 for opening/closing the outlet 39.

The valve body accommodation part 45 comprises an inner surface of a drum shape communicating with the outlet 39, and is connected to a gas discharging path 35 provided to discharge the compressed gas discharged through the outlet 39. Also, the inner surface of the valve body accommodation part 45 may be provided as a cylindrical shape for convenience of casting, or may have a polygon cross section such as a rounded triangle, or a rectangle.

The gas discharging path 35 is preferably, but not necessarily, formed through the top flange 31 to communicate with the valve body accommodation part 45. The gas discharging path 35 is preferably, but not necessarily, provided with a radius smaller than the inner surface of the valve body accommodation part 45 to prevent the valve body 41 accommodated in the valve body accommodation part 45 from deviating. Accordingly, the compressed gas discharged through the gas discharging path 35 can be discharged through the gas discharging tube 8.

The valve body 41 is rounded so that it is accommodated in the valve body accommodation part 45 and closes the outlet 39 elastically and opens the outlet 39 with the compressed gas. Also, the valve body 41 is preferably, but not necessarily, provided in a shape of a plate rounded so that it can be accommodated in the valve body accommodation part 45. In other words, as shown in FIG. 5, the valve body 41 has a cylindrical shape having one side opened, and preferably, but not necessarily, has a radius bigger than that of the valve body accommodation part 45 so that it can be accommodated in the valve body accommodation part 45 and press the inner surface of the valve body accommodation part 45 elastically. Also, the valve body 41 preferably, but not necessarily, comprises a first end 42 closing/opening the outlet 39, a second end 43 coupled with the valve body accommodation part 45, and a main body 44 provided between the first end 42 and the second end 43 and rounded to be adjacent to the inner surface of the valve body accommodation part 45. Also, the valve body 41 is preferably, but not necessarily, provided close to the inner surface of the cylinder 21 to reduce volume of the outlet 39 because the outlet 39 cannot be compressed by the roller 27. Accordingly, compression efficiency of the compression chamber 23 can be improved.

The first end 42 closes the outlet 39 elastically, and is spaced from the outlet 39 to permit opening of the outlet 39 as the gas compressed in the compression chamber 23 overcomes the elastic force and deforms the valve body 41. Also, the first end 42 is formed longitudinally along a direction to which the valve body 41 is inserted. The outlet 39 may be relatively big to correspond to the first end 42. As illustrated in FIG. 5, for example, the outlet may be shaped as an elongated slot, formed longitudinally along the direction in which the valve body 41 is inserted in the valve body accommodation part 45. As the outlet 39 becomes bigger, the degree of deformity of the valve body 41 caused by opening of the first end 42 is reduced relatively. Accordingly, the rigidity of the valve body 41 is increased. With the increment of the rigidity of the valve body 41, the compression efficiency of the compression chamber 23 can be improved.

As the main body 44 is provided to contact the inner surface of the valve body accommodation part 45, the first end 42 can supply the elastic force to close the outlet 39. Also, the main body 44 deforms when the first end 42 opens the outlet 39. Herein, because the main body 44 deforms while being wound in a coil shape, the stress caused by the deformity is distributed over the whole main body 44, which prevents the stress from being concentrated in one portion of the main body 44.

It is preferable, but not necessary, that the second end 43 extends toward the inner surface of the valve body accommodation part 45 from the main body 44, and the inner surface of the valve body accommodation part 45 is provided with a coupler 46 for accommodating and coupling with the second end 43. Also, it is preferable, but not necessary, that the second end 43 is an opposed end to the first end 42 and bent outward. Also, the second end 43 is inserted into the coupler 46 by the elastic force of the main body 44. The second end 43 prevents the valve body 41 from rotating as it is coupled with the coupler 46 by being inserted into the coupler 46.

Figure 6:
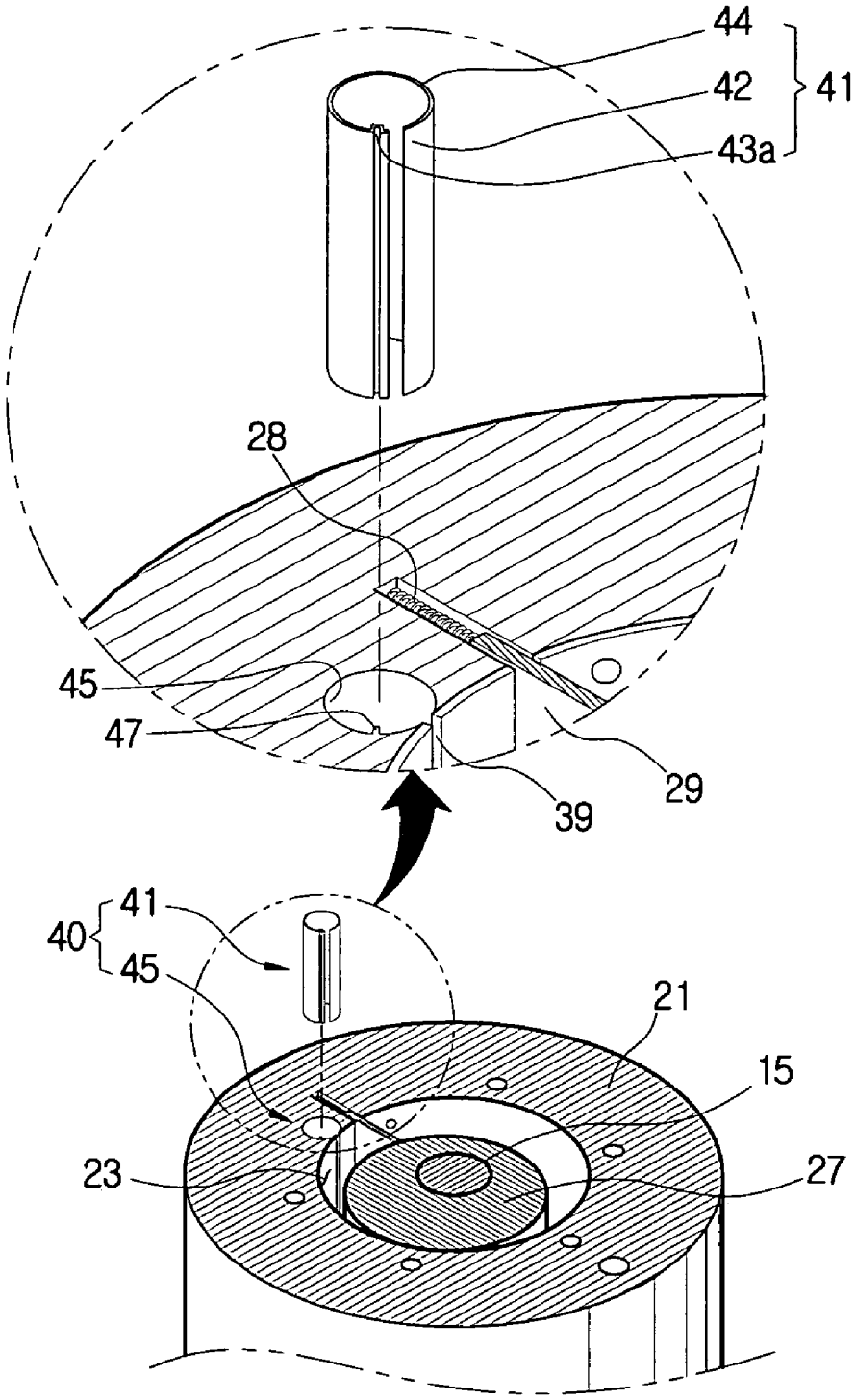
FIG. 6 is an exploded perspective view with another method of coupling of a valve body and a valve body accommodation part of the valve apparatus of the compressor according to the first embodiment of the present invention.

However, as shown in FIG. 6, the inner surface of the valve body accommodation part 45 may be provided with a protrusion 47 formed toward the valve body 41, and the second end 43 may be provided with a protrusion accommodation part 43A for accommodating and coupling with the protrusion 47 of the valve body accommodation part 45.

The protrusion 47 protrudes in a direction that the valve body 41 is inserted into from the inner surface of the valve body accommodation part 45. Also, the protrusion accommodation part 43A is preferably, but not necessarily, bent to accommodate the protrusion 47 at the same time when the valve body 41 is inserted into the valve body accommodation part 45. However, the protrusion accommodation part 43A may be formed by cutting an area of the second end 43 so that it can accommodate the protrusion 47 at the same time when the valve body 41 is inserted into the valve body accommodation part 45.

With such a configuration, an operation of the compressor 1 according to the above exemplary embodiment of the present invention will be described.

Figure 7:
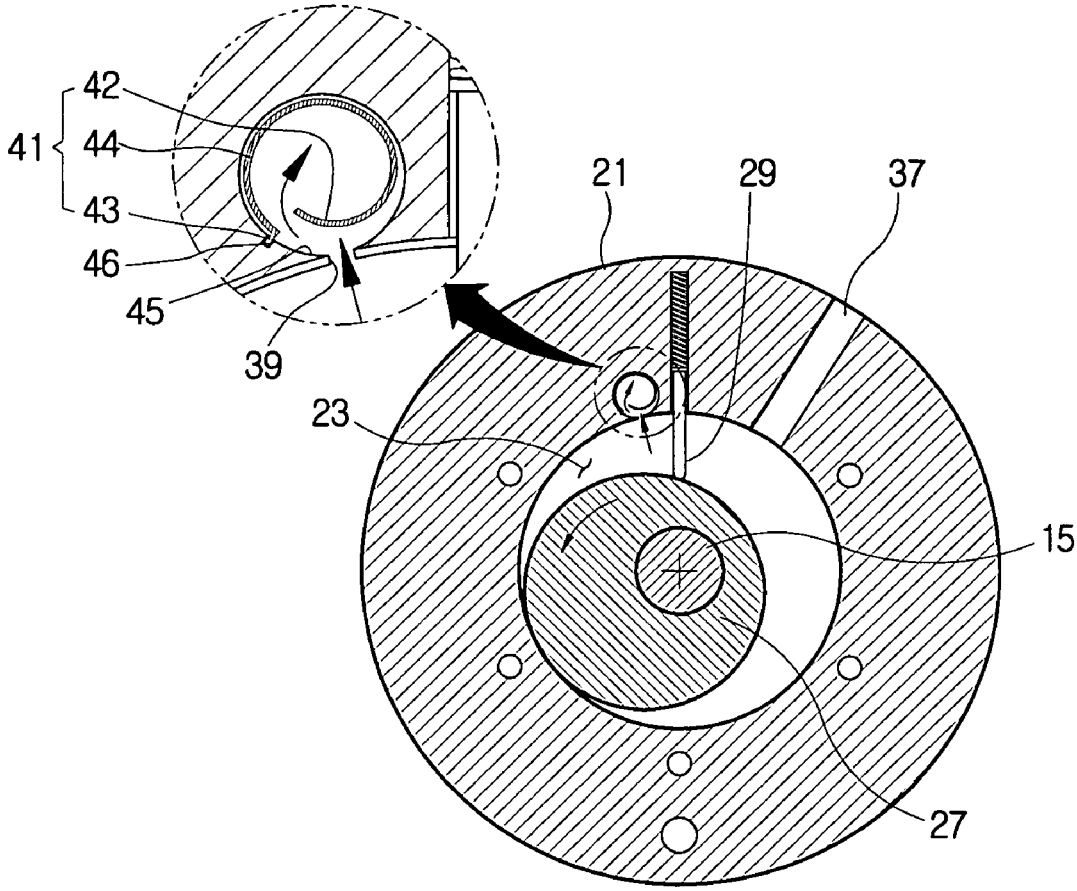
FIG. 7 is an operation cross sectional view of the compressor in FIG. 3.

Firstly, as the rotation shaft 15 rotates by the driving motor 10, the gas is inhaled into the compression chamber 23 of the cylinder 21 through the inlet 37. The inhaled gas is compressed by the roller 27 and the vane 29 rotating in the cylinder 21. Also, the compressed gas passes through the outlet 39 while deforming the valve body 41 by pressing the first end 42 of the valve body 41, as shown by example in FIG. 7. Also, the compressed gas that has passed the outlet 39 passes through the valve body accommodation part 45 and the gas discharging path 35 and discharges through the gas discharging tube 8 provided in the top area of the casing 3.

Accordingly, a life cycle of the valve apparatus 40 of the compressor 1 according to the first embodiment of the present invention is extended because the valve body 41 deforms by winding in a coil shape when the outlet 39 is opened to prevent the concentration of the stress.

Also, the compressor 1 according to the first embodiment of the present invention can improve the compression efficiency of the compression chamber 23 when the gas is compressed by providing the valve body 41 adjacent to the inner surface of the cylinder 21 so that the volume of the outlet 39 of the cylinder 21 is reduced.

The compressor 1 according to the first embodiment of the present invention has a simple configuration because there is no need for an additional member, such as a stopper, which is required in the conventional compressor for limiting the deformity of the valve body.

Also, the compressor 1 according to the first embodiment of the present invention may be provided with a bigger outlet 39 of the cylinder 21 corresponding to the first end 42 of the valve body 41. As the outlet 39 becomes bigger, the rigidity of the valve body 41 can be increased. Accordingly, the compression efficiency of the compression chamber 23 is improved.

Figure 8:
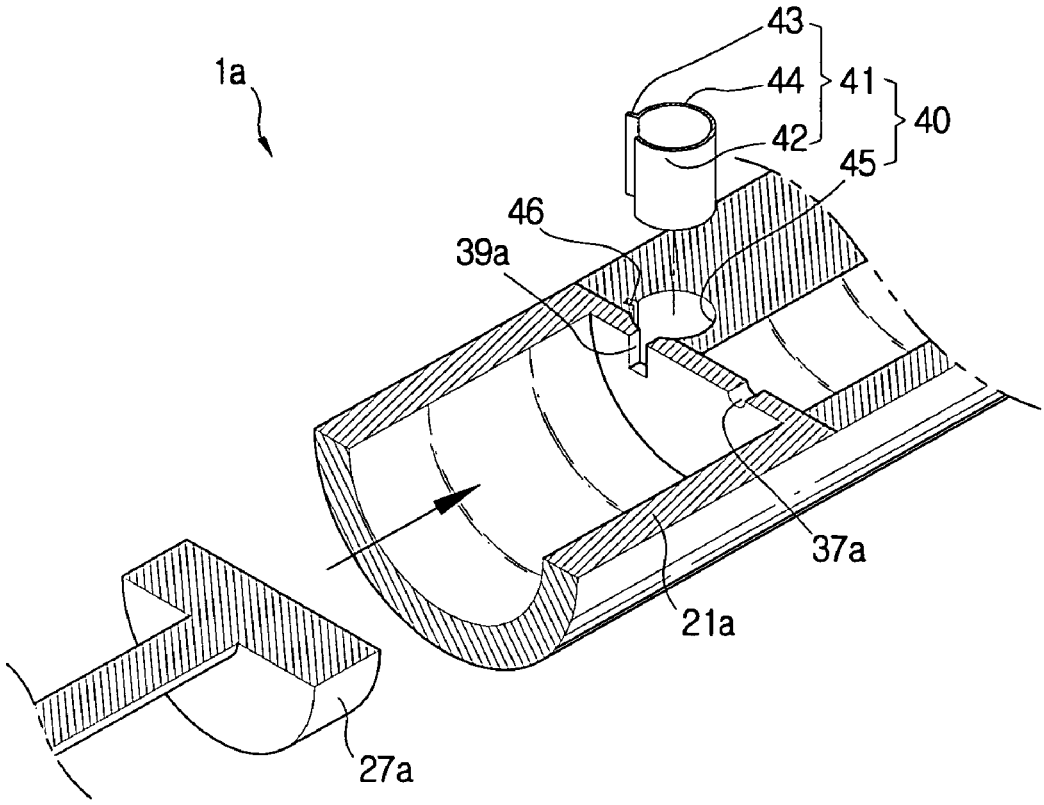
FIG. 8 is a schematic partial cross sectional view of a compressor according to a second embodiment of the present invention.
Figure 9:
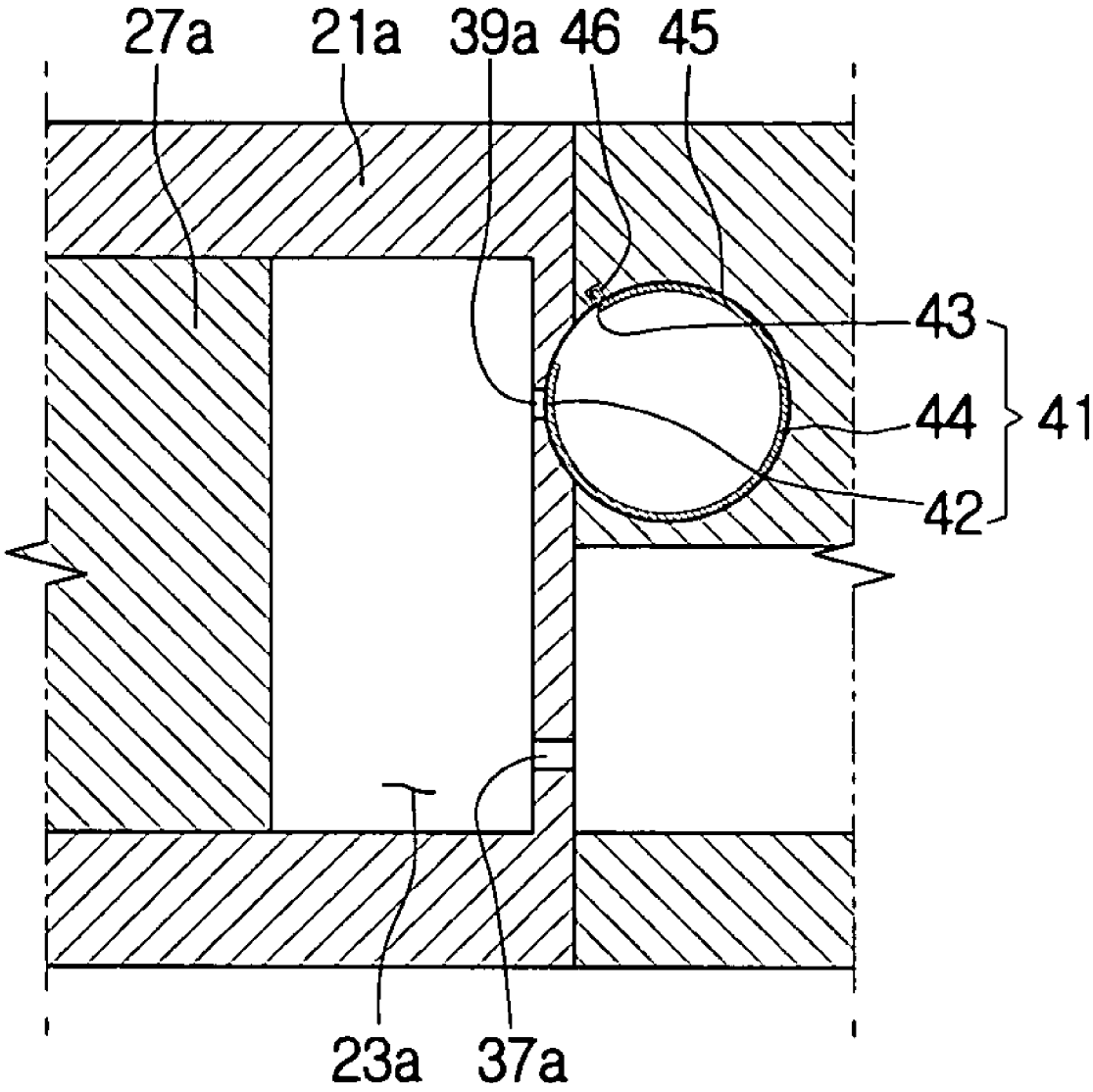
FIG. 9 is an exploded perspective view of the valve apparatus of the compressor in FIG. 8.
Figure 10:
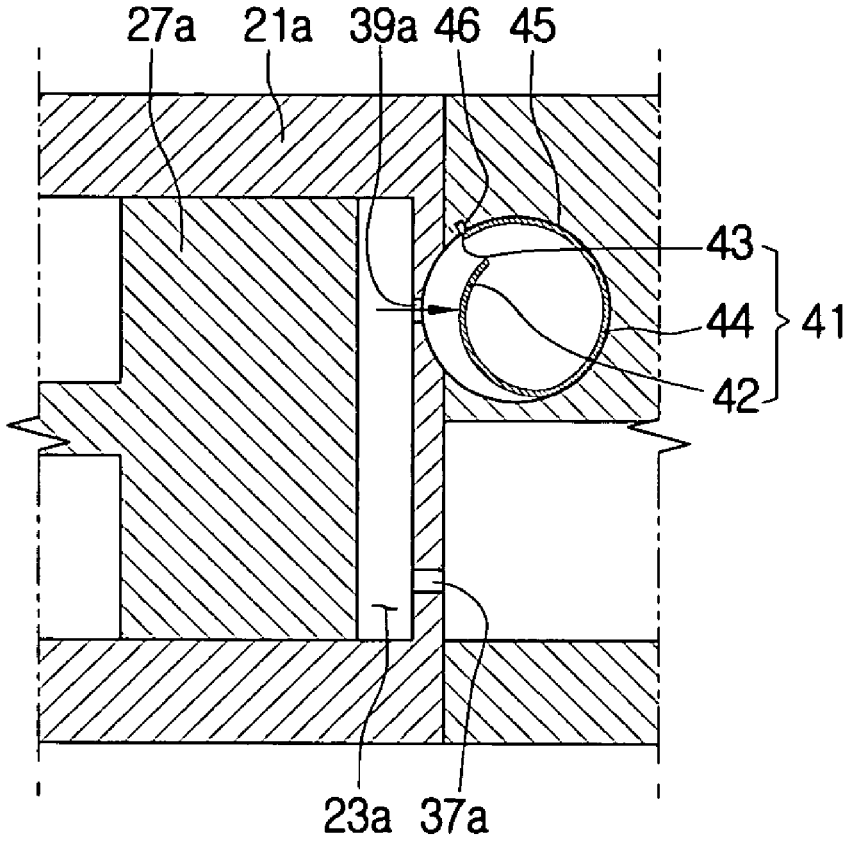
FIG. 10 is an operation cross sectional view of the compressor in FIG. 8.

FIGS. 8 through 10 are partial cross sectional views and a perspective view of a compressor 1 according to a second embodiment of the present invention.

As shown therein, a compressor 1*a* according to the second embodiment of the present invention comprises a cylinder 21*a* provided with an inlet 37*a* and an outlet 39*a*, a piston 27*a* inserted into the cylinder 21*a* for forming the compression chamber 23*a* and for reciprocating back and forth by a driving part (not shown), and a valve apparatus 40 for opening/closing the outlet 39*a* of the cylinder 21*a*. In other words, the compressor 1*a*, according to the second embodiment of the present invention, is preferably, but not necessarily, a compressor using a piston 27*a* or a cylinder 21*a* as a compression part as in a linear compressor, a reciprocal compressor, or a wobble plate compressor.

The piston 27*a* reciprocates or rotates in the cylinder 21*a* by the driving part (not shown) such as a linear motor (in a case of the linear compressor), a driving motor (in a case of the reciprocating compressor), and an engine (in a case of the wobble plate compressor).

As described in the first embodiment above, the valve apparatus 40 comprises a valve body accommodation part 45 comprising an inner surface of a cylindrical shape for communicating with the outlet 39*a* provided in the cylinder 21*a*, and a valve body 41 for opening/closing the outlet 39*a* as it is accommodated in the valve body accommodation part 45.

A detailed description of the valve body accommodation part 45 and the valve body 41 is not repeated here because they are similar to those of the first embodiment of the present invention.

In FIGS. 8 through 10, the second end 43 of the valve body 41 extends from the main body 44 toward the inner surface of the valve body accommodation part 45. The inner surface of the valve body accommodation part 45 is preferably, but not necessarily, provided with the coupler 46 formed in a direction in which the valve body 41 is inserted to accommodate and couple with the second end 43. However, the inner surface of the valve body accommodation part 45 may be provided with a protrusion (not shown) protruding toward the valve body 41 so that the valve body 41 cannot rotate in the valve body accommodation part 45. Also, the second end 43 may be provided with a protrusion accommodation part (not shown) to accommodate the protrusion of the valve body accommodation part 45.

With such a configuration, an operation of the compressor 1*a* according to the second embodiment of the present invention will be described.

Firstly, the piston 27*a* in the cylinder 21*a* moves leftward (FIG. 9) by the driving part (not shown). Also, the gas is inhaled into the compression chamber 23*a* through the inlet 37*a*. Then the piston 27*a* moves rightward (FIG. 10) and compresses the gas in the compression chamber 23*a*. Accordingly, the compressed gas is discharged through the outlet 39*a* as the valve body 41 is deformed and the outlet 39*a* is opened.

Accordingly, the compressor according to the second embodiment of the present invention can extend the life cycle of the valve body and improve the compression efficiency of the compression chamber as the first embodiment of the present invention described above does. Also, an additional member is not required to limit the deformity of the valve body. Accordingly, the configuration is simpler than the conventional devices.

As described above, the exemplary embodiments of the present invention provide a compressor having an extended life cycle for the valve body and an improved compression efficiency of the compression chamber. Also, an additional member for limiting the deformity of the valve body is not required, which simplifies a configuration of the compressor.

Although exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A compressor comprising a casing, a driving part adapted to be accommodated in the casing for generating a driving force, a compression part for compressing gas with the driving force from the driving part and provided with an inlet for inhaling the gas and an outlet for discharging the compressed gas, and a valve apparatus for opening/closing the outlet, the valve apparatus comprising:

a valve body accommodation part comprising an inner surface of a cylindrical shape for communicating with the outlet, and connected to a gas discharging path for discharging the compressed gas discharged through the outlet; and a valve body accommodated in the valve body accommodation part and curved to close the outlet elastically and to open the outlet with the compressed gas of the compression part, wherein the outlet is an elongated shaped slot formed longitudinally along a direction in which the valve body is inserted into the valve body accommodation part, so as to correspond to a first end of the valve body.

2. The compressor according to claim 1, wherein a second end of the valve body extends from the valve body toward an outside of the valve body accommodation part, and the inner surface of the valve body accommodation part is provided with a coupler to accommodate and couple with the second end.

3. The compressor according to claim 1, wherein the inner surface of the valve body accommodation part is provided with a protrusion protruding toward the valve body, and a second end of the valve body is provided with a protrusion accommodation part to accommodate and couple with the protrusion.

4. The compressor according to claim 3, wherein the inner surface of the valve accommodation part is of a drum shape.

5. The compressor according to claim 1, wherein the inner surface of the valve body accommodation part is of a drum shape.

6. The compressor according to claim 1, wherein the compression part comprises:

a moving part operated by the driving part; and a cylinder provided with the inlet and the outlet, and coupled with the moving part to form a compression chamber for compressing the inhaled gas.

7. The compressor according to claim 6, wherein the moving part comprises:

a roller coupled eccentrically relative to the driving part for contacting an inner surface of the cylinder rollably, and a vane coupled with the inner surface of the cylinder retractably and contacting the roller.

8. The compressor according to claim 6, wherein the moving part comprises a piston coupled relative to the driving part for reciprocating in the cylinder.

* * * * *